US009993053B2

(12) United States Patent
Jenan

(10) Patent No.: US 9,993,053 B2
(45) Date of Patent: Jun. 12, 2018

(54) UMBRELLA

(71) Applicant: Kazim Jenan, Hertfordshire (GB)

(72) Inventor: Kazim Jenan, Hertfordshire (GB)

( * ) Notice: Subject to any disclaimer, the term of this patent is extended or adjusted under 35 U.S.C. 154(b) by 296 days.

(21) Appl. No.: 14/431,468

(22) PCT Filed: Sep. 27, 2013

(86) PCT No.: PCT/GB2013/052524
§ 371 (c)(1),
(2) Date: Mar. 26, 2015

(87) PCT Pub. No.: WO2014/049367
PCT Pub. Date: Apr. 3, 2014

(65) Prior Publication Data

US 2015/0265013 A1 Sep. 24, 2015

(30) Foreign Application Priority Data

Sep. 28, 2012 (GB) ..... 1217411.6

(51) Int. Cl.
*A45B 25/06* (2006.01)
*A45B 25/02* (2006.01)
(Continued)

(52) U.S. Cl.
CPC ..... *A45B 25/06* (2013.01); *A45B 19/00* (2013.01); *A45B 19/06* (2013.01); *A45B 25/02* (2013.01); *A45B 2019/008* (2013.01)

(58) Field of Classification Search
CPC ... A45B 19/06; A45B 2019/008; A45B 25/02; A45B 25/06; A45B 25/14
See application file for complete search history.

(56) References Cited

U.S. PATENT DOCUMENTS 952,630 A * 3/1910 Philp ..... A45B 19/10 135/25.33
1,067,435 A * 7/1913 McNamara ..... A45B 19/06 135/22
(Continued)

FOREIGN PATENT DOCUMENTS

CN 201025938 Y 2/2008
CN 101711621 A 5/2010
(Continued)

OTHER PUBLICATIONS

Espacent, English Machine Translation of CN201025938Y, published Feb. 27, 2008, retrieved from https://worldwide.espacenet.com on Nov. 30, 2016 (4 pages).
(Continued)

*Primary Examiner* — David R Dunn
*Assistant Examiner* — Danielle Jackson
(74) *Attorney, Agent, or Firm* — Wood Herron & Evans LLP

(57) ABSTRACT

There is provided an umbrella (10, 110, 210, 310, 410, 510) moveable between an open position and a closed position, said umbrella comprising; a. a canopy framework (16, 18, 116, 118, 216, 218, 316, 318, 416, 418, 16, 518, 616, 618, 716, 718); b. a central spine (12, 112, 212, 312, 412, 512, 612, 712) configured to support the canopy framework; c. a main canopy (24, 124, 224, 324, 424, 524, 624, 724) configured to cover the canopy framework; and d. a tensioning mechanism 20, 22, 120, 122, 220, 222, 320, 322, 420, 422, 520, 522, 620, 62, 720, 722) configured to tension the main canopy about the canopy framework when the umbrella is in the open position and release the tension to the main canopy about the canopy framework to allow the umbrella to move to the closed position.

16 Claims, 11 Drawing Sheets

(51) Int. Cl.
*A45B 19/00* (2006.01)
*A45B 19/06* (2006.01)

(56) References Cited

U.S. PATENT DOCUMENTS

| | | | | | |
|---|---|---|---|---|---|
| 1,073,562 | A * | 9/1913 | Beaver | A45B 19/06 | 135/26 |
| 1,969,171 | A * | 8/1934 | Evans | A45B 25/02 | 135/22 |
| 1,969,821 | A * | 8/1934 | Saxon | A45B 19/04 | 135/26 |
| 2,173,305 | A * | 9/1939 | Marx | A45B 19/04 | 135/22 |
| 2,296,666 | A * | 9/1942 | Haupt | A45B 19/06 | 135/26 |
| 3,217,724 | A * | 11/1965 | Szivatz | A45B 19/06 | 135/25.33 |
| 3,672,382 | A * | 6/1972 | Sato | A45B 25/143 | 135/24 |
| 3,702,618 | A * | 11/1972 | Weber | A45B 19/06 | 135/26 |
| 3,732,880 | A * | 5/1973 | Weber | A45B 19/06 | 135/25.3 |
| 3,837,352 | A * | 9/1974 | Weber | A45B 19/06 | 135/20.1 |
| 4,149,553 | A * | 4/1979 | Lee | A45B 25/14 | 135/24 |
| 4,474,201 | A * | 10/1984 | Kida | A45B 11/00 | 135/20.1 |
| 5,050,627 | A * | 9/1991 | Hengtzu | A45B 25/143 | 135/23 |
| 5,913,321 | A | 6/1999 | Yung | | |
| 6,082,383 | A | 7/2000 | Wilson | | |
| 6,167,894 | B1 * | 1/2001 | Lin | A45B 25/02 | 135/15.1 |
| 6,311,707 | B1 * | 11/2001 | Wu | A45B 25/02 | 135/15.1 |
| 6,863,081 | B2 * | 3/2005 | Hsieh | A45B 25/02 | 135/25.3 |
| 8,240,322 | B2 * | 8/2012 | Chang | A45B 19/00 | 135/27 |
| 8,746,263 | B2 * | 6/2014 | Lee, II | A45B 25/02 | 135/20.3 |
| 8,893,736 | B2 * | 11/2014 | Kazim | A45B 19/04 | 135/20.3 |
| 9,538,819 | B1 * | 1/2017 | Hayes | A45B 25/18 | |
| 2004/0211451 | A1 | 10/2004 | Goh | | |
| 2005/0022459 | A1 * | 2/2005 | Chang | A45B 25/143 | 52/3 |
| 2006/0266396 | A1 * | 11/2006 | Perry, Jr. | A45B 19/06 | 135/31 |
| 2012/0160283 | A1 * | 6/2012 | Lee, II | A45B 19/10 | 135/20.3 |
| 2015/0096602 | A1 * | 4/2015 | Chan | A45B 25/06 | 135/28 |

FOREIGN PATENT DOCUMENTS

| | | | |
|---|---|---|---|
| DE | 195 05 707 | C1 | 3/1996 |
| EP | 1 005 804 | A1 | 6/2000 |
| EP | 2319350 | A2 | 5/2011 |
| GB | 1 266 264 | | 3/1972 |
| GB | 2 346 556 | A | 8/2000 |
| GB | 2 473 936 | A | 3/2011 |
| GB | 2485294 | A | 5/2012 |
| JP | S4892145 | A | 11/1973 |

OTHER PUBLICATIONS

Chinese Patent Office, Chinese Search Report for 2013800622361, dated Sep. 27, 2013 (1 page).

United Kingdom Intellectual Property Office, Patents Act 1977, Further Search Report under Section 17, Application No. GB1317163.2, dated Mar. 20, 2015 (1 page).

Espacenet, English Machine Translation of DE19505707C1, published on Mar. 7, 1996, retrieved from http://worldwide.espacenet.com on Mar. 19, 2015.

Espacenet, English Machine Translation of CN101711621A, published on May 26, 2010, retrieved from http://worldwide.espacenet.com on Mar. 19, 2015.

European Patent Office, International Search Report and Written Opinion of the International Searching Authority, International Application No. PCT/GB2013/052524, dated Mar. 4, 2014 (9 pages).

European Patent Office, Examination Report, Application No. 13774769.7, dated Mar. 19, 2018 (5 pages).

* cited by examiner

UMBRELLA

CROSS-REFERENCE TO RELATED APPLICATIONS

This application is a submission under 35 U.S.C. § 371 of International Application No. PCT/GB2013/052524, filed Sep. 27, 2013, which claims priority to Great Britain Application No. 1217411.6, filed Sep. 28, 2012, the disclosures of which are hereby expressly incorporated by reference herein in their entireties.

FIELD OF THE INVENTION

The present invention primarily relates, but is not limited, to umbrellas. It is particularly applicable to umbrellas in which the umbrella canopy folds inside out and preferably into the umbrella handle or a sleeve attached to the handle for storage. This folding arrangement keeps the wet side (i.e. the outside face) of the umbrella canopy away from the user and once folded, retains any remaining water within the wet side of the canopy and prevents it from dripping out. Optionally, an umbrella casing, cover or sleeve is so arranged to be an extension of the handle grip, to provide further seal against leakage.

BACKGROUND TO THE INVENTION

Attempts have been made to provide umbrellas that outwardly look like traditional umbrellas, but function differently. The aim being that instead of folding away the umbrella after use so that the wet external surface is still external in the closed configuration, it is internal in the closed configuration.

CN101711621 (Trade K K U) describes a traditional golf style umbrella. The umbrella described folds away after use so that the wet external surface is internal in the closed configuration. The problem with this is that the closed umbrella is longer in length that the closed umbrella. In addition in order for the umbrella canopy to be able to complete the movements described it would need to have a canopy which is much larger than a standard canopy and fit loosely on the canopy framework of the umbrella in the open position, as well as needing someone with really long arms to operate it!.

DE19505707 (Hoehfeld Jochen) also describes a similar traditional golf style umbrella. This suffers the same problems as described above.

GB2346556 and GB2473936 (Kazim Jenan) attempt to solve the same problem in a compact style umbrella which when folded is the same size as a standard compact style umbrella. However, this suffers from the same problem that in order for the umbrella canopy to be able to complete the movements described it would need to have a canopy which is much larger than a standard canopy and fit loosely on the canopy framework of the umbrella in the open position.

SUMMARY OF THE INVENTION

According to a first aspect of the present invention there is provided an umbrella moveable between an open position and a closed position, said umbrella comprising;

a. a canopy framework;

b. a central spine configured to support the canopy framework;

c. a main canopy configured to cover the canopy framework; and d. a tensioning mechanism configured to tension the main canopy about the canopy framework when the umbrella is in the open position and release the tension to the main canopy about the canopy framework to allow the umbrella to move to the closed position.

Preferably the main canopy is configured to be connected to the canopy framework. The canopy framework supports the main canopy and the connection helps to anchor the main canopy in position.

Preferably the tensioning mechanism is configured to vary the diameter of the canopy.

Preferably the canopy framework comprises a plurality of support arms. The plurality of support arms are preferably pivotally connected to the central spine, more preferably the plurality of support arms are pivotally connected to a sliding support configured to move about the central spine. The movement of the sliding support about the central spine results in the movement of the plurality of support arms and thus the canopy framework. This movement preferably results in the opening and closing of the canopy framework and thus the main canopy which covers it. In one alternative the plurality of support arms comprise a single strut as in the case of a traditional fixed length umbrella such as a golf umbrella, in an alternative the plurality of support arms comprise a plurality of struts which are pivotally connected together as in the case of a traditional folding umbrella.

Preferably the main canopy is configured to be connected to the plurality of support arms.

Preferably the tensioning mechanism is configured to vary the lengths of the plurality of support arms. Preferably the tensioning mechanism is configured to vary the lengths of the plurality of support arms after any unfolding of pivotally connected struts, in the case of a folding umbrella, has taken place.

Preferably the plurality of support arms are each provided with a sliding strut configured to slide about the respective support arm to vary the length thereof. It is preferably this sliding strut which varies the lengths of the plurality of support arms. When the full length of the sliding strut is about support arm, the support arm is at its shortest. When the sliding strut slides so that it is no long fully about the support arm and extends beyond the length of the support arm then the support arm is at its longest.

Preferably the main canopy is configured to be connected to the plurality of sliding struts. This means that when the sliding struts are moved to vary the length of the supports the main canopy is pulled along with the sliding struts resulting in the tensioning of the main canopy.

In one alternative the sliding struts are each provided with an extension lever and tensioning brace to actuate movement of the respective sliding strut. Preferably the extension lever at one end is connected to the remote end of the sliding strut. Preferably the extension lever at the other end is pivotally connected to one end of the tensioning brace. Preferably the other ends of the tensioning brace are supported by the central spine. More preferably the plurality of tensioning braces are pivotally connected to a sliding support configured to move about the central spine. The movement of the sliding support about the central spine results in the movement of the plurality of tensioning braces, extension levers and thus sliding struts to tension the main canopy. In one alternative the canopy frame work is further provided with a plurality of braces to support the respective support arms. Preferably one end of the brace is pivotally connected to the support arm and the other end is supported by the central spine, more preferably the other end is pivotally connected to a sliding support configured to move about the central spine. Preferably the pivot point between the extension levers and the tensioning braces are connected to the respective braces. Preferably this is a sliding connection such that the pivot point is configured to slide along the length of the brace, but is also provided support and resistance by the brace. In an alternative arrangement the pivot point is configured to slide along the length of the support arm.

Preferably one or more or all of the sliding supports are provided with locking or latching mechanisms to enable the sliding supports to be locked in desired positions about the central spine.

Preferably the tensioning mechanism is configured to slide the plurality of sliding struts about the plurality of support arms to vary the length thereof to tension the main canopy about the canopy framework.

Preferably the main canopy has an inside face closest the canopy framework and an outside face remote from the canopy framework such that when the umbrella is in the closed position the main canopy, which is usually wet after use, is folded inside out such that the outside face of the main canopy is folded upon itself substantially preventing water dripping from the main canopy and allowing the user to handle the dry inside face of the main canopy.

Preferably a cover sleeve and lid are provided which provide further protection against leakage and dripping.

Key components of an umbrella according to the present invention comprise:—

A Central Spine: This is a central pillar which is typically a tubular structure that in one alternative is hollow or another alternative is solid and not hollow. The central spine may be a cylinder, cuboid, hexagonal prism, triangular prism or other suitable shape. The central spine may be of a fixed un-adjustable length or in the alternative may be telescopic and of adjustable length. The central spine supports the canopy framework and the canopy. In its lowest section, the central spine supports a handle grip.

A Handle Grip: This is typically fixed on to the lowest segment of the central spine, the handle grip is also usually cylindrical and usually made out of plastic or wood. The sleeve cover for the umbrella, if present, in one alternative is fixed onto the handle grip. The sleeve cover may be made out of a flexible material such as fabric which may be rolled up or down, or the sleeve cover may be made out of tubing. In one alternative the sleeve cover is telescopic with one or more segments and preferably transparent to minimise the visual impact of the sleeve cover.

A Canopy Framework: This preferably comprises a plurality of support arms extending radially from the central spine. Each support arm may comprise a series of pivotally linked struts in substantially linear end-to-end alignment. In one alternative two struts are pivotally connected together for each support arm extending from the central spine. The main strut is preferably pivotally connected to a first sliding support which is configured to slide vertically along the central spine. The inner end of the main strut is preferably shaped so that the central axis of the main strut is offset from the pivot connection point on the first sliding support. When the umbrella and thus the canopy framework is in its closed position, this offset, from the pivot connection point, allows the main canopy to fold within the space between the main strut and the central spine. Preferably a sliding strut is provided at the end of the support arm which facilitates radial movement of the canopy for tensioning the canopy about the canopy framework and for releasing the tension of the canopy about the canopy framework. In an alternative arrangement the radial movement along the support arm is achieved by providing telescopically extendable support arms. Preferably a brace is pivotally connected to the support arm at one end and to a second sliding support at the other end which allows the second sliding support to slide along the outermost section of the central spine. In an alternative arrangement, the brace is pivotally connected to the tensioning brace at a one end and to a second sliding support at the other end which allows the second sliding support to slide along the outermost section of the central spine.

Tensioning mechanism: It has been discovered that there is an unmentioned inherent problem with umbrellas that open with the edge of the canopy moving from a position remote from the handle grip towards the handle grip, that the diameter of the canopy framework and thus the canopy gets progressively larger up to 90 degrees to the central spine and then gets progressively smaller as the tip of the canopy moves beyond. This means that if we were to make the diameter of the canopy fabric as large as it is required to be at 90 degrees to the central spine, the fabric will not be fully tensioned by the traditional arrangement of the canopy framework once the canopy rotates beyond this. The present innovation remedies this by uses a tensioning mechanism that allows the main canopy diameter to vary to suit various stages of the rotating canopy and tensions the canopy once the required orientation is achieved. The tension is then released allowing the canopy to rotate in the opposite direction to the closed position.

String and Pulley System: Preferably the movement of the sliding supports is facilitated by using a string and pulley system. The string is preferably kept under tension by using springs. Preferably there are four sliding supports used in the present invention. Preferably there is provided a first sliding support which is located furthest away from the handle grip which preferably supports the main canopy, and a second sliding support located further towards the handle grip which preferably supports the brace for the main canopy. Preferably the string and pulley system is arranged such that movement that reduces the gap between these first two sliding supports closes the canopy framework and thus the main canopy and movement that increases the gap between these two first sliding supports opens the canopy framework and thus the main canopy. Preferably there is also provided a third sliding support next in the sequence towards the handle grip which preferably actuates the tensioning mechanism. Finally there is preferably provided a fourth sliding support which preferably actuates the movement between the first two sliding supports that facilitate the opening and closing of the main canopy.

Actuation System: The actuation system comprises the string and pulley system and the tensioning mechanism as described above. Preferably the first sliding support supports the main canopy and the second sliding support offers a brace mechanism for the main canopy. Preferably, the three sliding supports nearest to the handle grip are provided with a latch and release arrangement so that it is possible for the sliding supports to either move together or are capable of being released to move independently as required.

There have been many years of development to design an umbrella that looks the same when open, same when closed and has the same operating characteristics as the conventional umbrellas, but uniquely wherein the canopy inverts inside out so that the dry side out the umbrella canopy is on the outside. This new type of folding inside out mechanism is easier to open in confined spaces, it is safer for the people in the vicinity when the umbrella being opened with the main canopy coming from top down as opposed to conventional which opens down up. For larger umbrellas such as garden or beach umbrellas it is easier to open and close without becoming trapped inside the canopy. The simple tensioning mechanism, using conventional umbrella parts, allows the canopy to change diameter as it moves from a closed position to an open position and then tensions the canopy. The tensioning mechanism has an additional advantage in that the final umbrella performs much better in windy conditions.

BRIEF DESCRIPTION OF THE DRAWINGS

The invention will now be described by way of example only, with reference to the accompanying drawings in which:—

DESCRIPTION OF THE PREFERRED EMBODIMENTS

Figure 1:
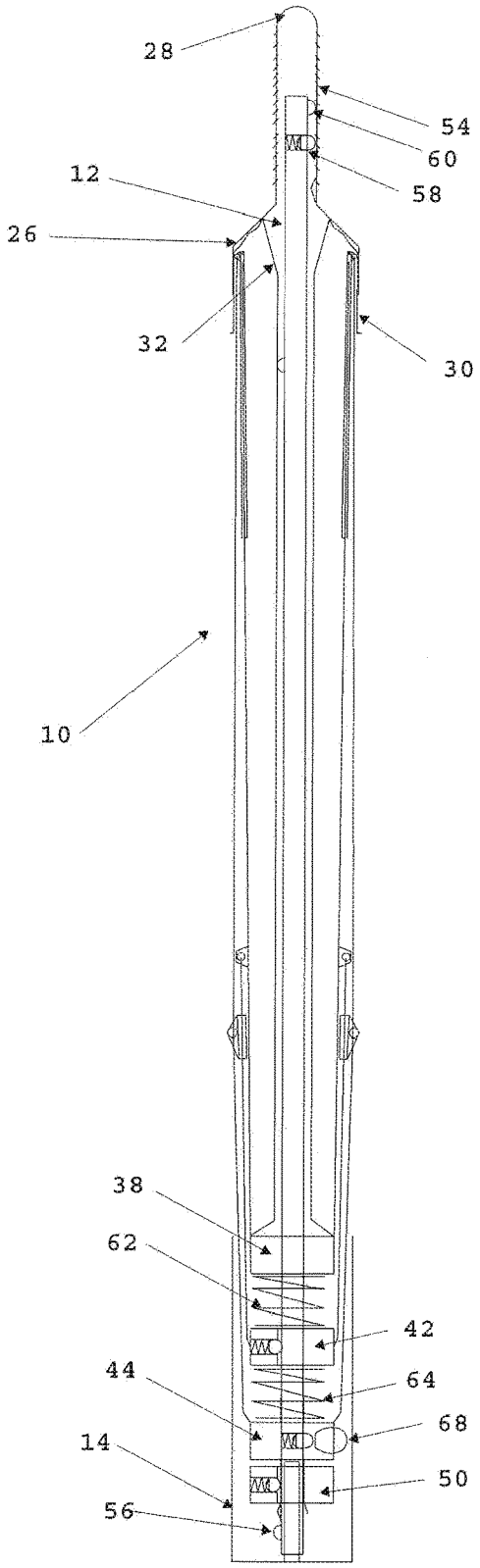
FIG. 1 illustrates an umbrella according to the first embodiment of the present invention in closed position.

The present aspects and embodiments represent currently the best ways known to the applicant of putting the invention into practice. But these are not the only ways in which this could be achieved. They are illustrated referring to the drawings, and they will now be described, by way of example only.

Figure 2:
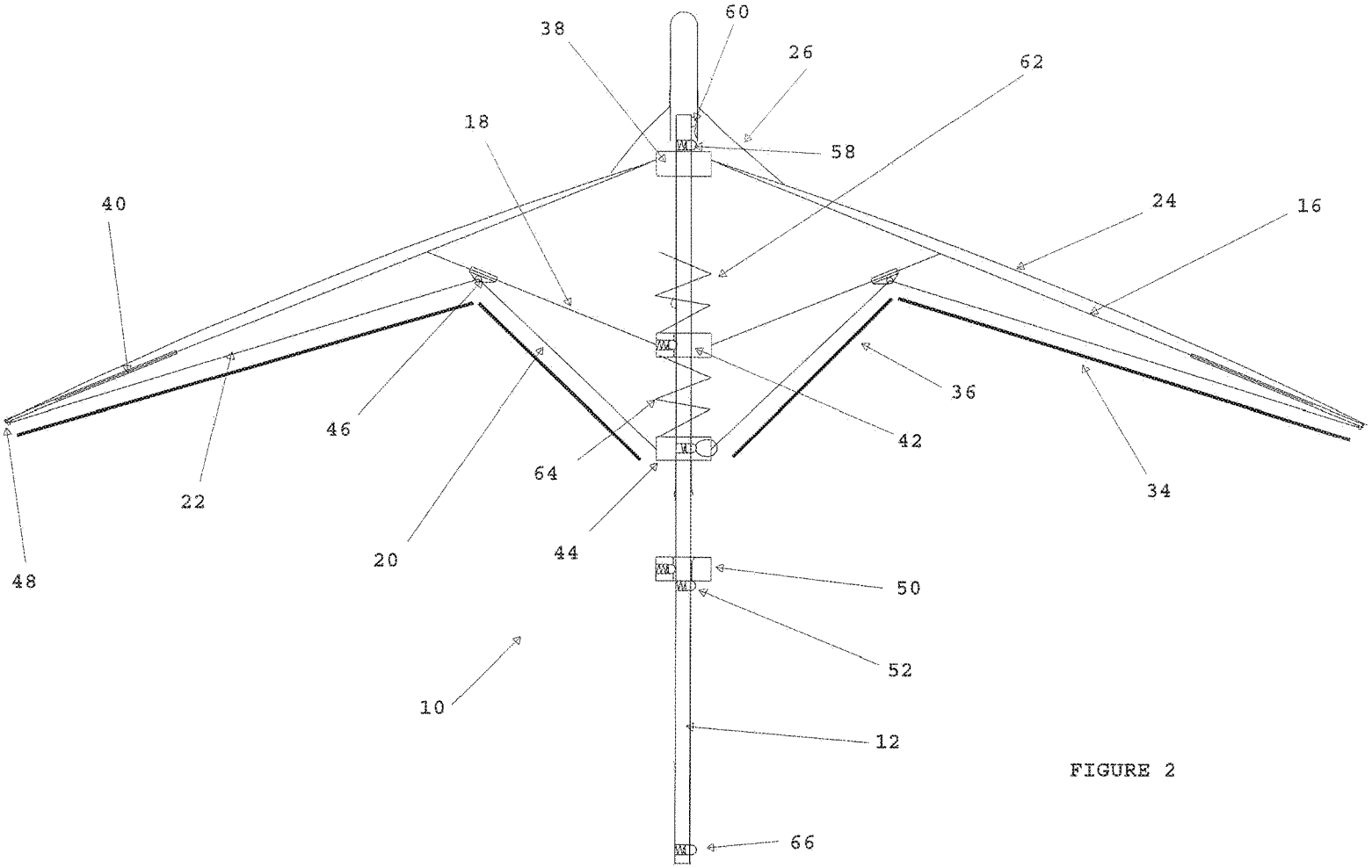
FIG. 2 illustrates the umbrella of FIG. 1 in open configuration.

FIGS. 1 and 2 illustrate an umbrella 10 according to a first embodiment of the present invention in its open and closed positions (or configurations). The umbrella 10 has a central spine 12; a handle grip 14; a canopy frame work comprising a plurality of support arms 16 and associated braces 18; a tensioning mechanism comprising a plurality of tensioning braces 20 and associated extension levers 22; a main canopy 24; a mini canopy 26; and an end cap 28. In the embodiment as illustrated the umbrella 10 further comprises a first optional sleeve 30 to assist in retaining any water within the closed umbrella and a second optional sleeve 32 to assist in preventing water ingress into the central spine 12 and the internal mechanisms of the central spine 12 which will be described later. The illustrated umbrella 10 also has optional internal canopies 34, 36 which act to hide the canopy framework and tensioning mechanism when the umbrella 10 is in the open position.

The central spine 12 is a typically tubular structure that supports the canopy framework, tensioning mechanism and the main canopy 24. In its lowest section the central spine 12 supports the handle grip 14. In its uppermost section the central spine 12 supports a string and pulley system which will be described later. In one alternative the central spine 12 is telescopic and of variable length, however in the embodiment illustrated the length of the central spine is fixed, and is not telescopic.

The handle grip 14 is fixed on to the lowest section of the central spine 12. The handle grip 14 is usually cylindrical and is usually made from plastic or wood. In the embodiment illustrated the handle grip 14 is hollow and configured to receive a portion of the canopy framework, tensioning mechanism and the main canopy 24 when the umbrella 10 is in the closed configuration as can be seen in FIG. 1. This helps to maintain the full length of the umbrella 10 in the closed position being consistent with traditional umbrellas. In an alternative the handle grip 14 is solid is not configured to retain any portion of the portion of the canopy framework, tensioning mechanism or the main canopy 24 when the umbrella 10 is in the closed configuration. In yet a further alternative a sleeve cover (not shown) for the umbrella 10, is fixed onto the handle grip. The sleeve cover in one alternative is made out of a flexible material such as fabric which may be rolled up or down, in another alternative the sleeve cover is made out of tubing, in one alternative telescopic with one or more segments and in one alternative transparent to minimise the visual impact of the sleeve cover.

The general principal of the umbrella 10 of the present invention is that the main canopy 24 has an inside face closest the canopy framework and an outside face remote from the canopy framework such that when the umbrella 10 is in the closed configuration the main canopy 24 is folded inside out such that the outside face of the main canopy 24, which is usually wet after use, is folded upon itself, substantially preventing water dripping from the main canopy 24 and allowing the user to handle the dry inside face of the main canopy 24.

The canopy framework has a plurality of support arms 16 extending radially from the central spine 12. Each support arm 16 may in one alternative be a single strut or in an alternative comprise a series of pivotally linked struts in substantially linear end-to-end alignment. In the embodiment of the invention illustrated in FIGS. 1 and 2 there is a single strut for each support arm 16 extending from the central spine 12. The strut located closest to the central spine 12 is called the main strut and is pivotally connected to a first sliding support 38 which is configured to slide vertically along the central spine 12. In the embodiment illustrated as any one strut is present this is the main strut. The inner end of the main strut is shaped so that the central axis of the main strut is offset from the pivot connection point on the first sliding support 38. This means that when the umbrella 10 and thus the canopy framework is in its closed position, the fact that the main strut is offset from the pivot connection point allows the main canopy 24 to fold within the space between the main strut and the central spine 12. The support arm 16 is further provided with a sliding strut 40 at the end of the series of struts, if provided, or main strut, which facilitates radial movement of the main canopy 24 for tensioning and for releasing the tension of the main canopy 24 about the canopy framework. The sliding strut 40 is configured to slide along and over the support arm 16 such that the total length of the support arm 16 can be increased when the sliding strut 40 extends over the end of the support arm 16 during the tensioning of the main canopy 24.

The canopy framework is further provided with associated braces 18 which are pivotally connected to respective support arms 16 at one end and to a second sliding support 42 at their other end. The second sliding support 42 is also configured to slide vertically along the central spine 12.

The tensioning mechanism has a plurality of tensioning braces 20 and associated extension levers 22 pivotally connected thereto extending radially from the central spine 12.

Each of the tensioning braces 20 are pivotally connected at one end to a third sliding support (tensioning sliding support) 44 which is configured to slide vertically along the central spine 12. Each of the tensioning braces 20 are also pivotally connected to an associated extension lever 22 at their other end. The pivot connection point between the respective tensioning braces 20 and extension levers 22 are slidably connected by a sliding pivot 46 to their respective brace 18 of the canopy framework and are configured to be able to slide along the full length thereof. The end of the extension levers 22 that are not connected to the tensioning braces 20 are pivotally connected at point 48 to the respective sliding struts 40 of the canopy framework.

The movement of the three sliding supports 38, 42, 44 about central spine 12 as discussed above is controlled by using a string and pulley system. The string is preferably kept under tension by using springs or in the alternative by using an elasticated material as will be discussed later in relation to FIGS. 6 to 10. As well as the three sliding supports 38, 42, 44 already discussed there is further provided a fourth sliding support 50. In summary the first sliding support 38 supports the support arms 16 and the main canopy 24, the second sliding support 42 supports the braces 18 for the main canopy 24. In one alternative the string and pulley system is arranged such that movement that reduces the gap between these first two sliding supports 38, 42 closes the canopy framework and thus the main canopy 24 and movement that increases the gap between these first two sliding supports 38, 42 opens the canopy framework and thus the main canopy 24. The third sliding support (tensioning sliding support) 44 actuates the tensioning mechanism. The fourth sliding support 50 actuates the movement between the first two sliding supports 38, 42 that facilitate the opening and closing of the main canopy 24. The actuation system comprises string and pulley system and the tensioning mechanism as described above.

In the embodiment as illustrated the three sliding supports 38, 42, 44 are provided with a latch and release arrangement 52 so that it is possible for them to either move together and are also capable of being released to move independently as required.

Sleeve 32 is attached to the main canopy 24 near the first sliding support 38, and extends up to mini canopy 26. In one alternative the outer surface of sleeve 32 is provided with a waterproof coating to allow for retention of the water located on the outside face of the main canopy 24 after used within the main canopy 24 and the sleeve 32 when the umbrella 10 is in the closed position. A portion of the sleeve 32 close to the mini canopy 26 and within the mini canopy 26 may be made from a water absorbing material to assist in water egress. The mini canopy 26 is provided with a first optional sleeve 30 which is configured to be extended over the folded main canopy 24 when the umbrella is in the closed position to provide further seal against the egress of water. The inside of the sleeve 30 in one alternative is formed from or coated with a material configured to absorb water again to water egress. End cap 28 on the tip of the umbrella 10 is configured to support the mini canopy 26. The end cap 28 in one alternative is perforated 54 as illustrated to allow air circulation within the sleeve 32 and the mini canopy 26 to prevent the growth of mould or bacteria or the like. The central spine 12 in one alternative is a hollow cylinder which is open at both ends to further facilitate circulation of air. In a further alternative (not shown) the central spine is further perforated along its length. A stopper 56 is provided at the base of the central spine 12 which provides final stop closed position for the umbrella 10. A latch 58 and stopper 60 are provided at the top of the central spine 12 to allow the end cap 28 and the mini canopy 26 to move into a locked position when the main canopy 24 is open and lowered as necessary to provide a cover for the ends of the main canopy 24 and canopy framework when closed. As discussed above four sliding supports 38, 42, 44, 50 are provided which are configured to slide along the outermost portion of the central spine 12; they actuate opening, closing and tensioning of the main canopy 24 and provide support when the umbrella is in the open position. Springs 62, 64 are provided and both act as a spacer between the sliding supports and also help initiate movement of the sliding supports. In a further alternative, a narrow band of water absorbing fabric may also be attached to the inside face of the main canopy 24 as a further measure against water egress. This is because when the main canopy 24 is folded, there are a number of layers close to the tip of the umbrella and water may move between the layers.

In use when the string and pulley system is utilised to move the first sliding support 38 away from the second sliding support 42, the main canopy marked 24 rotates from the closed position where the dry inside face of the canopy is on the outside and flips over so that the wet outside face is on the outside. The mini canopy 26 opens and stretches over the top of the main canopy 24. The fourth sliding support 50 which actuates the movement of the first sliding support 38 away from the second sliding support 42 comes to rest when the first sliding support 38 meets the latch 58 and cannot move anymore. The third sliding support (tensioning sliding support) 44 continues to be pushed up, pushing the tensioning braces 20 which results in the sliding pivots 46 moving along braces 18, which in turn results in the extension of extension levers 22. As noted above extension levers 22 are pivotally connected to the sliding struts 40 at point 48 and the sliding struts 40 are configured to slide about the support arms 16. The sliding struts 40 are also, at their end furthest from the central spine 12, connected to the main canopy 24. This arrangement means that as the extension levers 22 are extended the sliding struts 40 slide along the support arms 16 away from the central spine 12 and in doing so pushes the main canopy 24 along the support arm 16 via the sliding struts 40, essentially changing the length of the support arm 16 which supports the main canopy 24. When the required tension in the main canopy 24 is achieved, the third sliding support (tensioning sliding support) 44 locks in place which in turn locks the canopy framework in the open position. This locking mechanism in one alternative is provided by latch 52 upon which the third sliding support (tensioning sliding support) 44 rests. In one alternative spring 64 is configured to couple the second and third sliding supports 42, 44 so that the tensioning is further assisted by braces 18.

Releasing the third sliding support (tensioning sliding support) 44 in turn releases the tension in the main canopy 24 and allows the radius of the combination of the support arms 16 and the sliding struts 40 to vary as required whilst the main canopy 24 is inverted outside in. Latch 66 is the lower locking latch for the third sliding support (tensioning sliding support) 44 when the main canopy 24 is folded. Additional inner canopies 34, 36 may also be used as coverings for tension braces 20 and extension levers 22 to provide additional protection against water leakage or dampness. These additional internal canopies 34, 36 will also make handling of the canopy framework and tensioning mechanism safer because the frames would be behind the fabric of the inner canopies 34, 36. In one alternative either one or other of the canopies 34, 36 are provided, in another alternative both canopies 34, 36 are provided separately in yet another alternative both canopies 34, 36 are provided as a single canopy. The internal canopies 34, 36 will also improve the performance of the umbrella 10 in the wind.

Figure 3:
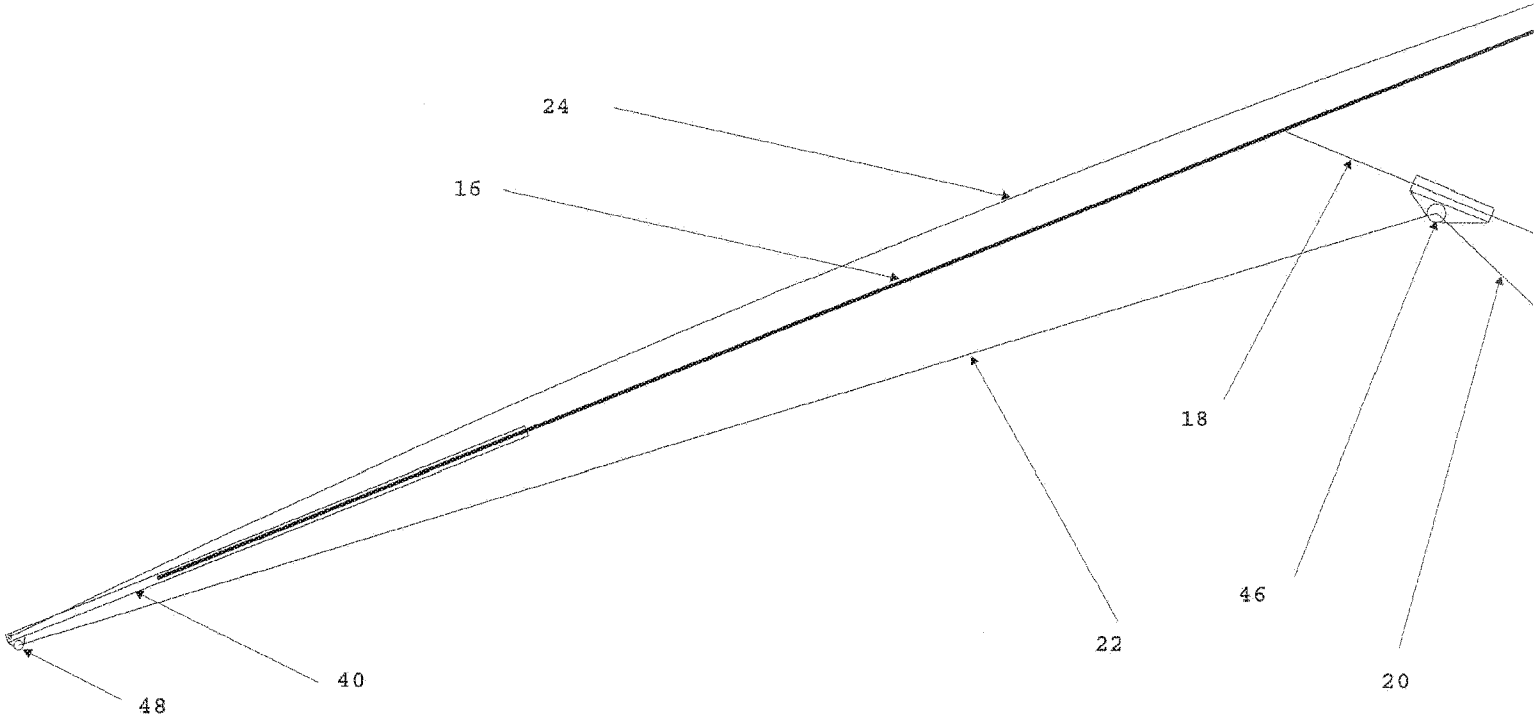
FIG. 3 illustrates the umbrella canopy detailing the tensioning elements shown in FIG. 2.

FIG. 3 illustrates the tensioning mechanism in more detail. The tensioning mechanism includes the tensioning brace 20, sliding pivot 46 which moves along brace 18, and extension lever 22 for extending the sliding strut 40 which is arranged, in one alternative to telescopically to move along the support arm 16, effectively extending the length of the support arm 16 during the tensioning step to stretch out the main canopy 24. The extension lever 22 is pivotally connected to the sliding strut 40 at point 48. The main canopy 24 is also attached to sliding strut 40. In one alternative the sliding struts 40 are tubular elements which fit around the full cross section of the support arms 16. In another alternative the sliding struts 40 only fit around a portion of the full cross section of the support arms 16. In a further alternative corresponding grooves or channels and protrusions are provided in the sliding struts 40 and the support arms 16 to allow the sliding struts 40 to slide along the support arms 16.

Figure 4:
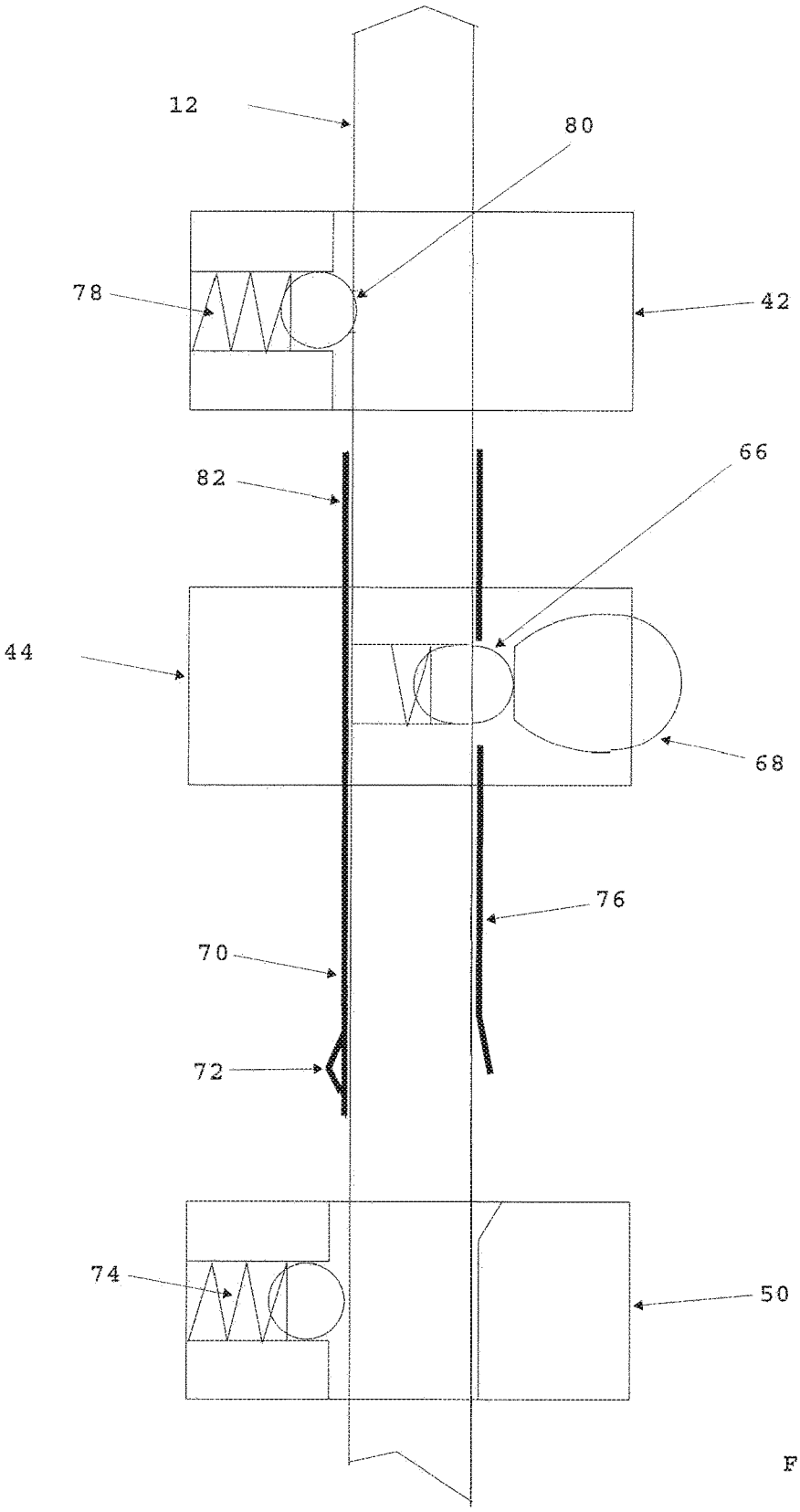
FIG. 4 illustrates the latch and release arrangement for the three sliders closest to the handle grip according to the first embodiment of the present invention.

FIG. 4 illustrates the latch and release mechanisms in more detail which latch the first, second and third sliding supports 38, 42 and 44 and release them at the required stages of the process of opening or closing the umbrella 10. This allows the user to move just a single sliding support, which is the same as with conventional umbrellas. When the single sliding support is moved by the user all the other movements of the other sliding supports relative to each other are achieved by latching or releasing the various sliding supports as required. In FIG. 4, the third sliding support 44 is the one that is moved by the user. When the canopy framework and thus the main canopy 24 is being opened from the closed configuration, the release button 68 is pressed. This allows the latch 66 to release the third sliding support 44. At this stage the sliding supports 38, 42, 44 and 50 are close together and a first spring arm 70 which is attached to the third sliding support 44 is positioned through the fourth sliding support so that the wedge 72 on the first spring arm 70 is past latch mechanism 74. This ensures that when the third sliding support 44 is moved upwards along the central spine 12, the fourth sliding support 50 is moved upwards as well. Movement of the third sliding support 44 actuates the movement of the first sliding support 38 away from the second sliding support 42 via a string and pulley system, examples of which are shown in FIGS. 6 to 10. The movement of the first sliding support 38 away from the second sliding support 42 initiates the opening of the canopy frame work and thus the main canopy 24. The canopy framework and thus the main canopy 24 rotates into the open position and stops when the first sliding support 38 comes to a rest position along the central spine 12, i.e. when the first sliding support 38 comes into contact with the latch 58 and stopper 60. When this happens, the fourth sliding support 50 is unable to move upwards anymore and as such when the third sliding support 44 is moved further the wedge 72 of first spring arm 70 moves past latch 74 releasing the third sliding support 44 from the fourth sliding support 50. When the main canopy 24 and thus the canopy framework is closed a second spring arm 76 which is connected to the third sliding support 44 passes through the fourth sliding support 50, releasing latch 52 located below it which allows the third and fourth sliding supports 44, 50 to lock together for movement down the central spine 12.

The second sliding support 42 is moved up the central spine 12 as the first sliding support 38 moves upwards until latch 78 locks in to aperture 80 on the central spine 12. This allows the third sliding support 44 to continue to move up the central spine 12 whilst the second sliding support 42 is temporarily held, which ensures the tensioning mechanism is mobilised. When the third sliding support 44 has moved sufficiently up the central spine 12 the third spring arm 82 attached to the third sliding support 44 passes through the second sliding support 42 releasing latch 78 so both the second and third sliding supports 42, 44 are able to move further until full tensioning of the main canopy 24 is achieved.

Figure 5:
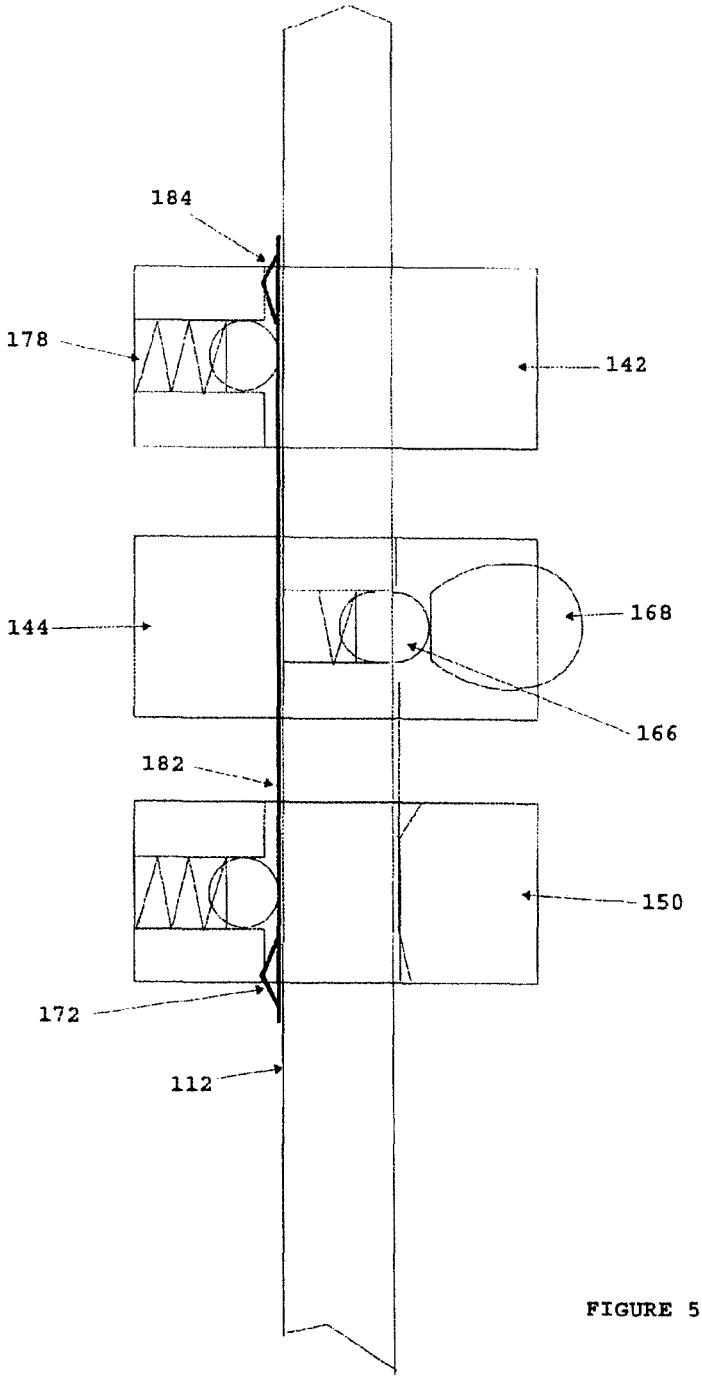
FIG. 5 illustrates an alternative additional feature to the latch and release arrangement illustrated in FIG. 4.

FIG. 5 illustrates an additional feature that can be incorporated into the latch mechanisms illustrated in FIG. 4. In this case a further latch and release mechanism is incorporated between the second and third sliding supports 142, 144. In this alternative, spring arm 182, which is attached to third sliding support 144, is also provided with a wedge 184 in addition to wedge 172. When the umbrella is closed, second sliding support 142 is close enough to third sliding support 144 such that wedge 184 is on the upper side of latch 178. Third sliding support 144 is at lower locking latch 166 when the main canopy 24 is folded. Thus, when release button 168 is pressed and the third and fourth sliding supports 144, 150 move upwards along the central spine 112, causing the first sliding support (not shown) to move away from the second sliding support 142, this additional latch mechanism means that the second sliding support 142 is held back ensuring that the canopy framework and thus the main canopy 24 opens up. This opening of the canopy framework and thus the main canopy 24 can also be assisted by the use of springs 62, 64 as shown in FIGS. 1 and 2.

Figure 6:
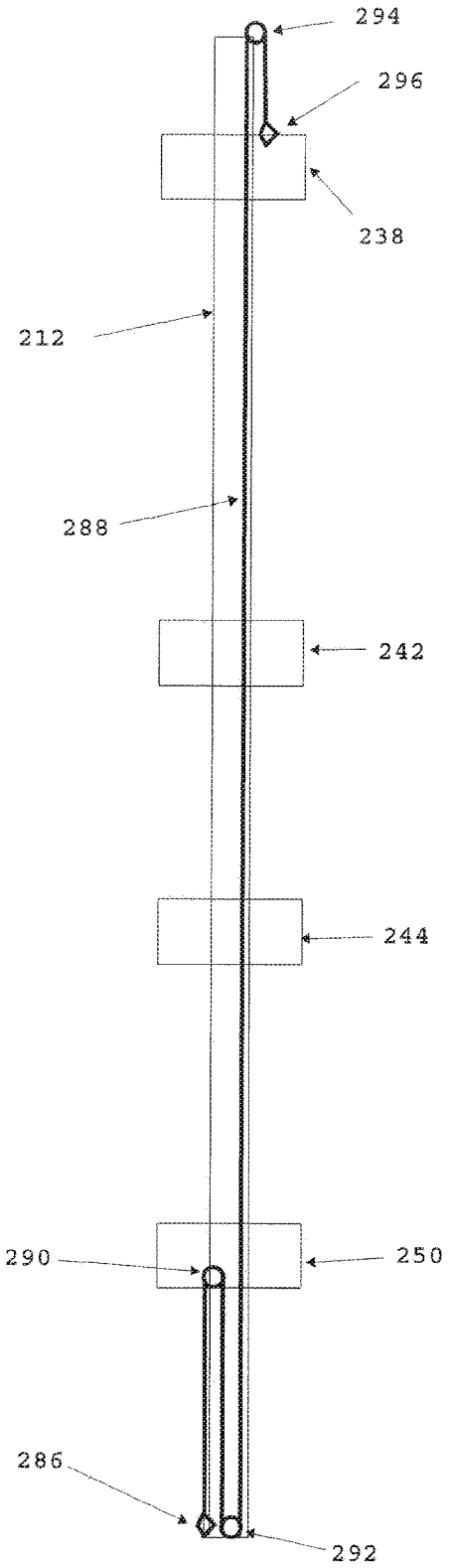
FIGS. 6 to 10 illustrate various ways that the pulley and string systems can be used to mobilise the required movements of the sliders to achieve the desired opening and closing of the canopy framework and thus the canopy of the umbrella.

FIG. 6 illustrates a first alternative arrangement for the string pulley system with the sliding supports 238, 242, 244 and 250 shown as being uncoupled from each other and released from the latch system explained in relation to FIGS. 4 and 5. In the alternative shown in FIG. 6 the fourth sliding support 250 is the actuator for moving the first sliding support 238 upwards along the central spine 12 and away relative to the second sliding support 242 to open the umbrella 10. When umbrella 10 is in the closed configuration, all four sliding supports 238, 242, 244, 250 are close together as illustrated in FIG. 1. When the fourth sliding support 250 moves upwards along the central spine 212, because of the arrangement of the string and pulley system illustrated in FIG. 6 the first sliding support 238 is moved twice the distance that is moved by the fourth sliding support 250. In this alternative, the string 288 is fixed at position 286 below the fourth sliding support 250 on the central spine 212. The string 288 then passes round a first pulley 290 which is attached to the fourth sliding support 250 and back down to pass around a second pulley 292 attached to the central spine 212. The string 288 then passes around a third pulley 294 which is attached to the central spine 212 close to the top thereof and finally fixed on to the first sliding support 238 at position 296. As the fourth sliding support 250 with first pulley 290 moves, the distance between the first pulley 290 and fixing position 286 and the distance between the first pulley 290 and the second pulley 292 increases, and thus the length of string 288 in these regions also increases resulting in the length of string 288 available between the second pulley 292 and the third pulley 294 and thus the third pulley 294 and fixing point 296 to shorten by twice the amount of the movement of the fourth sliding support 250. This causes the first and second sliding supports 238, 242 to move apart opening the umbrella 10. This action of moving a sliding support up a central spine relative to hand grip is exactly how conventional umbrellas are opened by the user.

Figure 7:
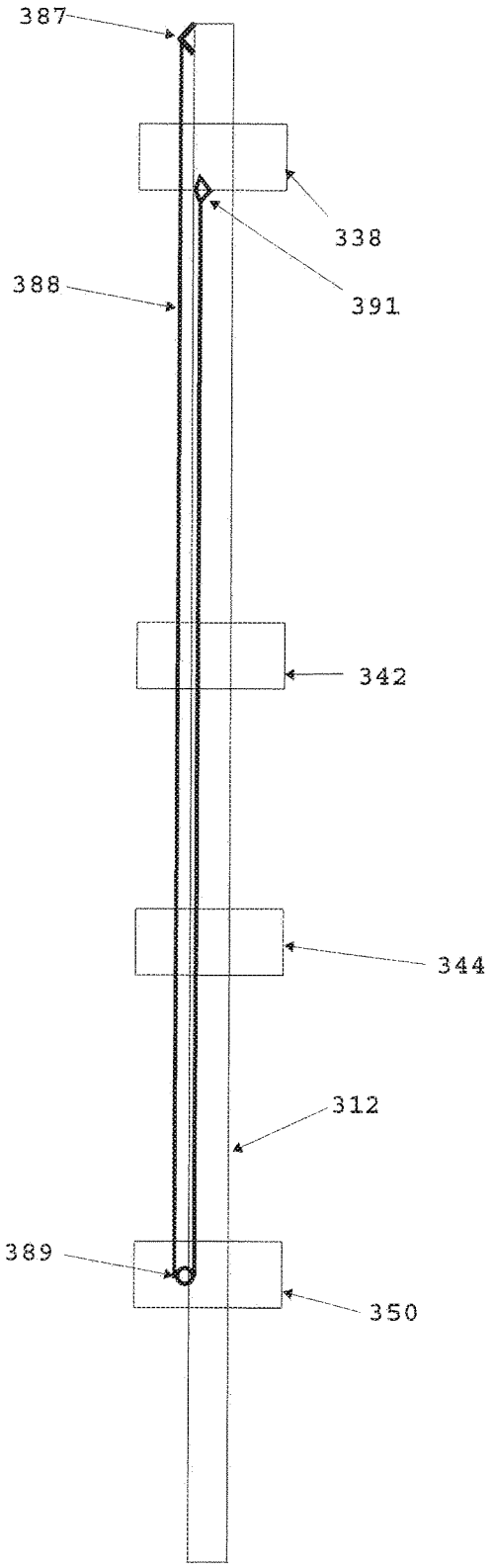

FIG. 7 illustrates an alternative arrangement of a string and pulley system. In this alternative the sting and pulley system is arranged to bring the first sliding support 338 towards the second, third and fourth sliding supports 342, 344, 350. The sliding supports 338, 342, 344, 350 again are shown as being uncoupled. The string 388 is attached to the central spine 312 at point 387. The first pulley 389 is attached to the fourth sliding support 350. The string 388 is stretched from fixing point 387 around the first pulley 389 and then fixed at point 391 to first sliding support 338. This arrangement is for moving the first sliding support 338 down towards the rest of the sliding supports 342, 344, 350 and is achieved by pulling the first sliding support 338 down towards the hand grip to close the umbrella 10. This action for the user is again exactly the same as how conventional umbrellas are closed by the user.

Figure 8:
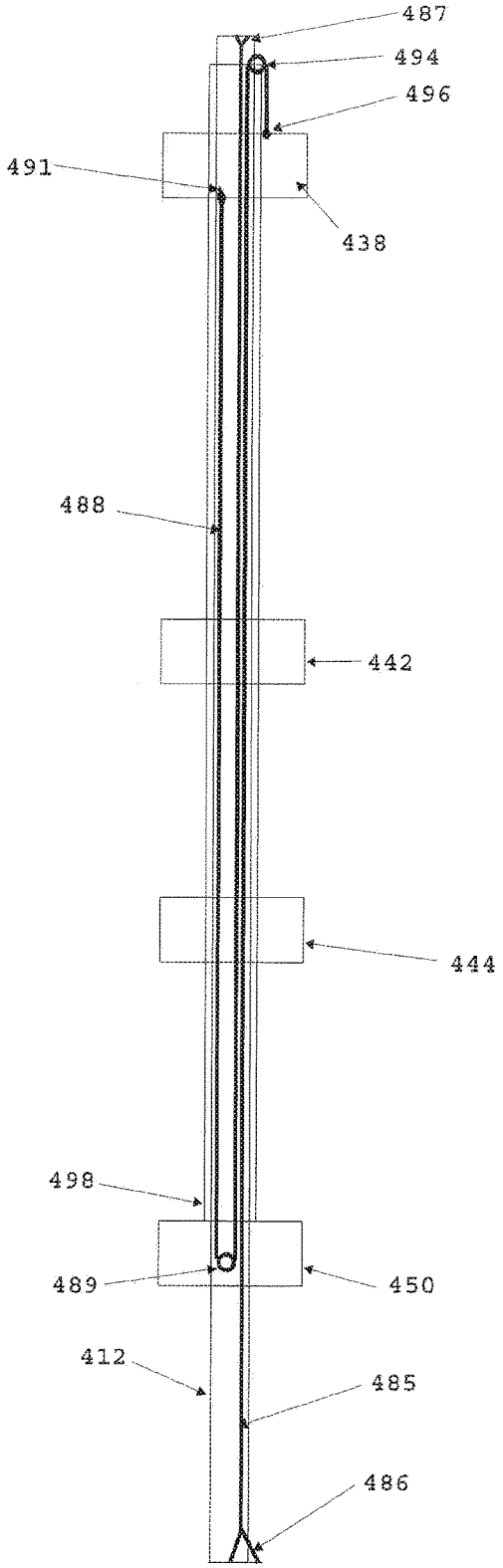

FIG. 8 illustrates a further alternative arrangement string and pulley system which works using the same principle. In this case the fourth sliding support 450 which actuates the motion of the first sliding support 438 has a sleeve 498 attached to it which extends as far as is required for opening and closing the umbrella 10. The string 485 arrangement for moving the first sliding support 438 close to the rest of the sliding supports 442, 444, 450 to result in the closing the umbrella 10 is exactly same as that illustrated in FIG. 7. The string 485 is attached to the central spine 412 at point 486 and attached to the first sliding support 438 at point 496. The second pulley 494 is attached to the central spine 412. However, the string 488 arrangement to open the umbrella 10 as shown in FIG. 6 has been simplified by introducing a sleeve 498 attached to the actuating fourth sliding support 450 so that the pulley 489 attached to the fourth sliding support 450 can be placed remote from the first sliding support 438 at a distance that allows the first sliding support 438 to move to the height required to open the umbrella 10. The string 488 is attached to the central spine 412 at point 487 and attached to the first sliding member at point 491. The first pulley 489 is attached to the fourth sliding support 450. This arrangement requires two less pulleys than the arrangement shown in FIG. 6. The two additional pulleys in FIG. 6 are only required to change the direction of the string 388. In this alternative, this is achieved by the sleeve 498 instead.

Figure 9:
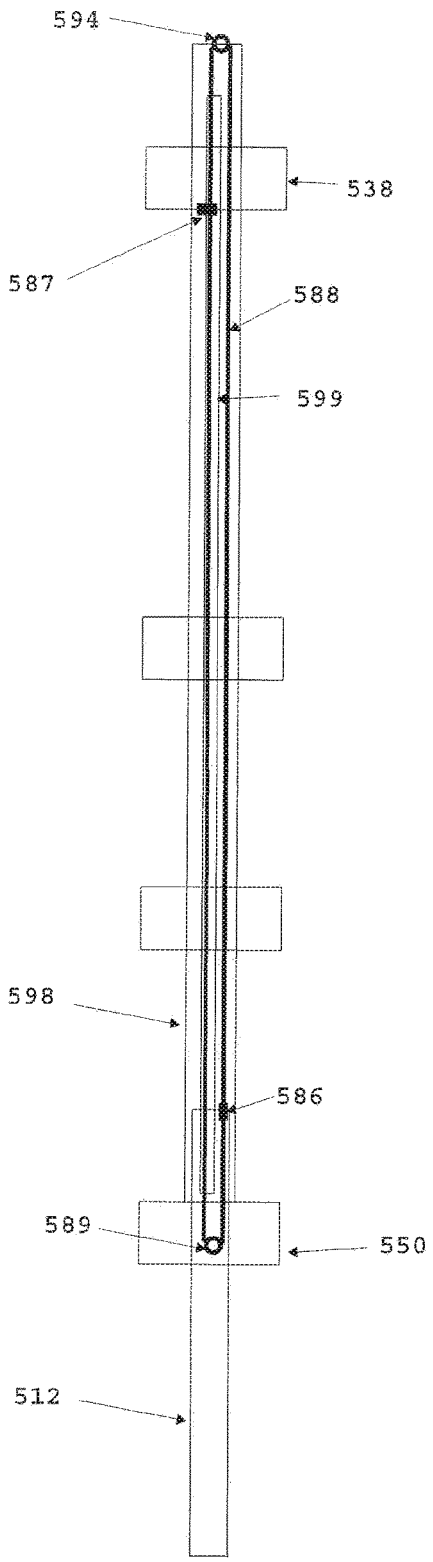

FIG. 9 illustrates an alternative arrangement in which the central spine 512 and the sleeve 598, which is attached to the actuating fourth sliding support 550, are arranged telescopically. The string 588 is fixed on to the central spine 512 at point 586 and to the first sliding support at point 587. A first pulley 589 is attached at a position lower than fixing point 586 on to the fourth sliding support 550 and a second pulley 594 is attached on to the sleeve 598 at a distance remote from the first pulley 589 so that the first sliding support 538 is able to have the full movement required to open and close the umbrella. The sleeve 598 is also provided with a slot 599 to allow the string to be fixed to the central spine 512.

Figure 10:
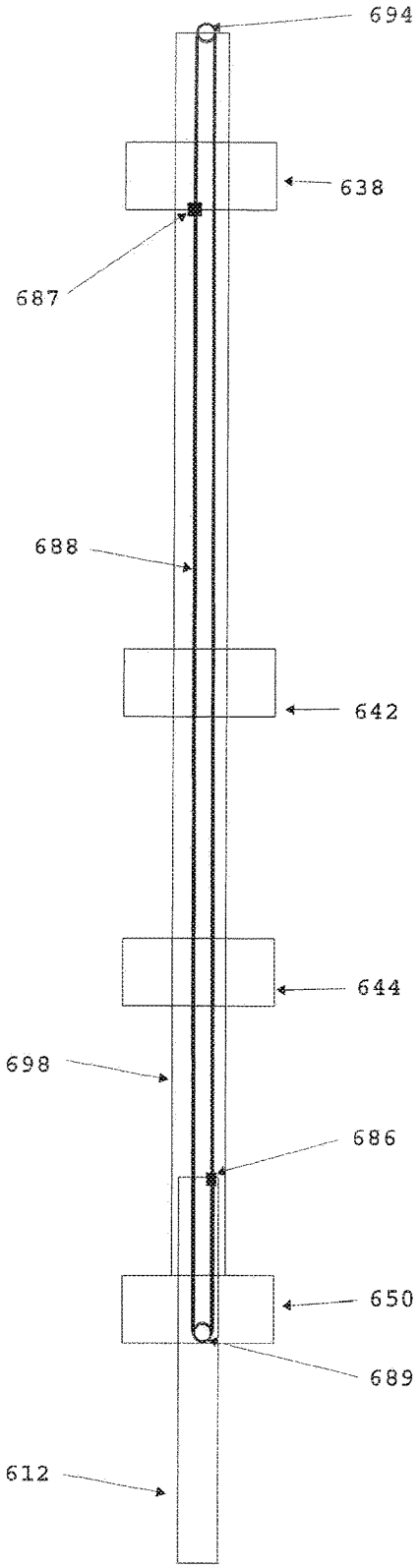

FIG. 10 illustrates a further alternative arrangement which is similar to arrangement shown in FIG. 9 but in this case there is no slot provided in sleeve 698. The string 688 that is attached to the central spine 612 at point 686 is positioned between the sleeve 698 and the central spine 612. String 688 is attached to the first sliding support 638 at point 687, above second and third sliding supports 642, 644. First pulley 694 is attached to the central spine 612. With pulley 689 being located within the fourth sliding support 650 and the fourth sliding support being configured to accommodate the string 688 inside.

Figure 11:
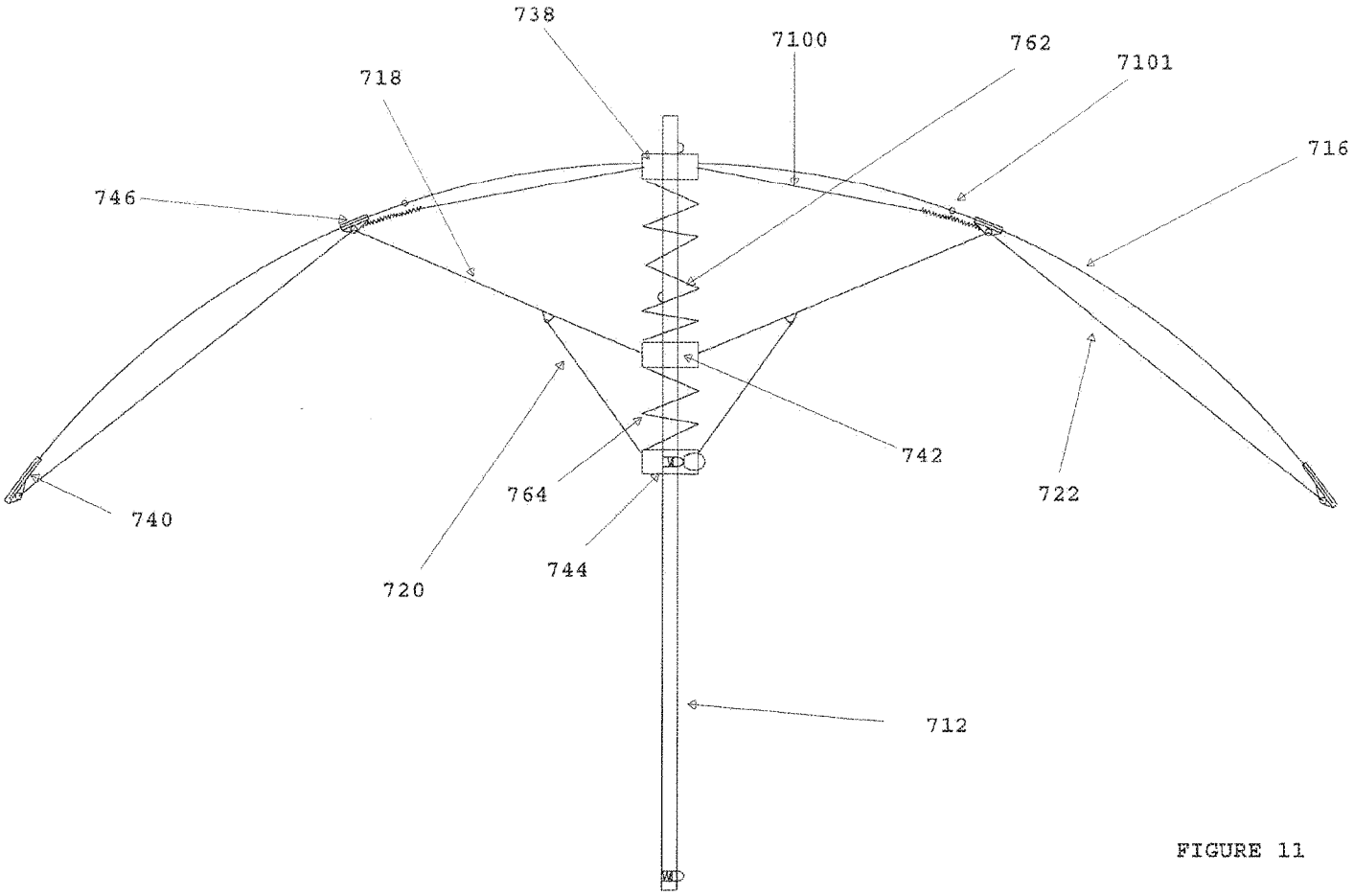
FIG. 11 illustrates an alternative arrangement of the tensioning elements to those illustrated in FIG. 2

FIG. 11 illustrates an alternative arrangement of the tensioning elements first illustrated in FIG. 2. In this alternative sliding pivot 746 is configure to slide along support arm 716 rather than tensioning brace 718. In this alternative an optional extendible strut 7100 may be provided between sliding support 738 and sliding pivot 746. Extendible strut 7100 may be, for example, extensible, telescopic, elastic, sprung, or stretchable. In this alternative an optional stopper 7101 may be provided to restrict or limit the movement of sliding pivot 746 about support arm 716. The canopy has not been shown in this Figure. Central spine 712, tensioning braces 720 and associated extension levers 722, sliding strut 740, second and third sliding supports 742, 744, and springs 762, 764 are also shown in this embodiment.

In all arrangements the string may be proved with springs to assist in maintaining the required tension in the string. In a further alternative the string may be elasticated.

The present aspect and embodiment represent currently the best ways to the application of putting the invention into practice. The four sliding supports are shown uncoupled as they each serve a function. The fourth sliding support, closest to the handle grip actuates the movement of the first sliding support to facilitate the opening and closing of the canopy. The first sliding support supports the support arms that support the main canopy. The second sliding support supports the braces that brace the support arms that support the main canopy. The third sliding support actuates the tensioning mechanism of the main canopy. The tensioning mechanism is required because the motions of the main canopy form closed to open positions and then tensioning of the fabric once deployed, necessitates changes in the diameter of the main canopy. This mechanism illustrates one way how this is achieved. FIGS. 6 to 10 outlines way of achieving movement of the sliding supports without altering the way the user understands how an umbrella is opened or closed. FIGS. 4 and 5 illustrate how for both practicality and for ease of use the latch and release mechanism can be used to achieve coupling and decoupling of the three lower sliding supports to achieve this.

The invention claimed is:

1. An umbrella moveable between an open position and a closed position, said umbrella comprising;

a. a canopy framework comprising a plurality of support arms and a plurality of associated braces, wherein the plurality of support arms are each provided with a sliding strut configured to slide about the respective support arm to vary the length thereof;

b. a central spine configured to support the canopy framework;

c. a main canopy configured to cover and be connected to the canopy framework, said main canopy having an inside face closest to the canopy framework and an outside face remote from the canopy framework;

d. a tensioning mechanism configured to tension the main canopy about the canopy framework when the umbrella is in the open position and release the tension to the main canopy about the canopy framework to allow the umbrella to move to the closed position;

e. a first sliding support configured to slide vertically along the central spine and support the support arms, wherein movement of the first sliding support causes the canopy framework, and thus the main canopy, to rotate from the open position to the closed position wherein the main canopy is folded inside out such that only the inside face of the main canopy is exposed, and from the closed position back to the open position;

f. a second sliding support configured to slide vertically along the central spine and support the braces, wherein movement of the second sliding support causes the sliding struts to slide about the respective support arm to vary the length thereof and thus the diameter of the main canopy;

g. a third sliding support configured to slide vertically along the central spine and actuate the tensioning mechanism; and h. a fourth sliding support configured to slide vertically along the central spine and actuate the movement between the first two sliding supports to facilitate the opening and closing of the main canopy;

wherein the second, third and fourth sliding supports are provided with a latch and release arrangement to enable them to be moved together and released to move independently as required.

2. An umbrella as claimed in claim 1 wherein when the umbrella is in the closed position, movement of the third sliding support up the central spine actuates movement of the first, second, and fourth sliding supports.

3. An umbrella as claimed in claim 2 wherein when the umbrella is in the closed position, movement of the third sliding support up the central spine actuates movement of the first sliding support away from the second sliding support which causes the canopy framework, and thus the main canopy, to rotate from the closed position to the open position.

4. An umbrella as claimed in claim 3 wherein once the umbrella is in the open position, further movement of the third sliding support up the central spine further actuates movement of the first sliding support away from the second sliding support until the third sliding support encounters a latch configured to release the actuation of movement between the third and fourth sliding supports to allow the third sliding support move independently of the fourth sliding support.

5. An umbrella as claimed in claim 4 wherein once the actuation of movement between the third and fourth sliding supports, and the third and first sliding supports has been released, further movement of the third sliding support up the central spine further actuates movement of the second sliding support which causes the sliding struts to slide about the respective support arm to increase the length thereof and thus the diameter of the main canopy.

6. An umbrella as claimed in claim 5 wherein once the diameter of the main canopy has been increased, further movement of the third sliding support up the central spine actuates movement of the second sliding support until the second sliding support encounters a latch configured to release the actuation of movement between the third and second sliding supports, which allows the third sliding support to move closer to second sliding support.

7. An umbrella as claimed in claim 6 wherein once the actuation of movement between the third sliding support relative to and second sliding support has been released, further movement of the third sliding support up the central spine further actuates the tensioning mechanism, to tension the main canopy about the canopy framework.

8. An umbrella as claimed in claim 1 wherein when the umbrella is in the open position, movement of the third sliding support down the central spine actuates the tensioning mechanism, to release the tension the main canopy about the canopy framework.

9. An umbrella as claimed in claim 8 wherein once the tension of the main canopy about the canopy framework has been released, movement of the third sliding support down the central spine relative to the second sliding support continues until the third sliding support encounters a latch configured to reengage the actuation of movement between the third and second sliding supports.

10. An umbrella as claimed in claim 9 wherein once the actuation of the relative movement between the third and second sliding supports has been reengaged, movement of the third sliding support down the central spine actuates movement of the second sliding support which causes the sliding struts to slide about the respective support arm to decrease the length thereof and thus the diameter of the main canopy.

11. An umbrella as claimed in claim 10 wherein further movement of the third sliding support down the central spine continues until the third sliding support encounters a latch configured to reengage the actuation of movement between the third and first sliding supports and the third and fourth sliding supports.

12. An umbrella as claimed in claim 11 wherein once the actuation of movement between the third and first sliding supports and the third and fourth sliding supports has been reengaged, further movement of the third sliding support down the central spine actuates movement of the first sliding support towards the second sliding support which causes the canopy framework, and thus the main canopy, to rotate from the open position to the closed position.

13. An umbrella as claimed in claim 1 wherein the tensioning mechanism is configured to vary the lengths of the plurality of support arms.

14. An umbrella as claimed in claim 1 wherein the main canopy is configured to be connected to the plurality of support arms.

15. An umbrella as claimed in claim 1 wherein the main canopy is configured to be connected to the plurality of sliding struts.

16. An umbrella as claimed in claim 1 wherein the tensioning mechanism is configured to slide the plurality of sliding struts about the plurality of support arms to vary the length thereof and to tension the main canopy about the canopy framework.

* * * * *